United States Patent [19]

Hauptman

[11] 4,356,676

[45] Nov. 2, 1982

[54] SEALANT STRIP

[75] Inventor: Arthur Hauptman, Brooklyn, N.Y.

[73] Assignee: Norton Company, Worcester, Mass.

[21] Appl. No.: 303,804

[22] Filed: Sep. 21, 1981

[51] Int. Cl.[3] ..... E04C 1/10; E04B 1/10; B32B 3/26; B32B 7/12

[52] U.S. Cl. ..... 52/403; 52/233; 52/309.9; 428/40; 428/71; 428/317.3; 428/319.7; 428/354; 428/906

[58] Field of Search ..... 428/40, 71, 317.3, 319.3, 428/319.7, 319.9, 351, 354, 906; 52/233, 403, 309.8, 309.9

[56] References Cited

U.S. PATENT DOCUMENTS

| | | | |
|---|---|---|---|
| 2,292,024 | 8/1942 | Dreher | 428/317.3 |
| 2,395,668 | 2/1946 | Kellgren et al. | 428/40 |
| 2,565,509 | 8/1951 | Marcin | 428/354 |
| 2,882,183 | 4/1959 | Bond et al. | 428/355 |
| 3,173,826 | 3/1965 | Campbell et al. | 428/317.3 |
| 3,202,540 | 8/1965 | Stare et al. | 428/319.7 |
| 3,380,582 | 4/1968 | Moyer, Jr. et al. | 428/314.4 |
| 3,528,866 | 9/1970 | Stevens | 428/319.7 |
| 4,126,977 | 11/1978 | Chisum | 52/233 |
| 4,158,278 | 6/1979 | Cardinale et al. | 428/34 |
| 4,169,184 | 9/1979 | Pufahl | 428/337 |
| 4,199,645 | 4/1980 | Schwarz | 428/339 |
| 4,232,489 | 11/1980 | Corvington et al. | 52/63 |

*Primary Examiner*—William J. Van Balen
*Attorney, Agent, or Firm*—Arthur A. Loiselle, Jr.

[57] ABSTRACT

A sealant strip is provided having a soft, resilient synthetic foamed resin core, preferably having a pressure sensitive adhesive coating on at least one of two of the opposed sides of the core and thin preferably silicone rubber sealing layers cured in situ on the two remaining surfaces of the core. The strip is adapted for adhesive attachment to and compression between structural members, with the core supporting the edges of the sealing layers in contact with the opposed surfaces of the structural elements between which the strip has been compressed.

14 Claims, 3 Drawing Figures

SEALANT STRIP

TECHNICAL FIELD

This invention relates to a flexible resilient sealant strip for use between structural and non-structural elements to form an effective air and moisture barrier.

BACKGROUND ART

Prior Art Statement

The following publications are representative of the most relevant prior art known to the Applicant at the time of filing the application:

| U.S. Pat. Nos. | | |
|---|---|---|
| 2,292,024 | August 4, 1942 | D. F. Dreher |
| 2,395,668 | February 26, 1946 | W. Kellgren et al |
| 2,565,509 | August 28, 1951 | B. C. Marcin |
| 2,882,183 | April 14, 1959 | H. M. Bond et al |
| 4,169,184 | September 25, 1979 | J. Pufahl |
| 4,199,645 | April 22, 1980 | Gunter Schwarz |
| 4,232,489 | November 11, 1980 | E. J. Corvington et al |

Various types of flexible sealant strips have been proposed that carry a pressure sensitive adhesive for attaching the strip to a surface to be protected. One such known weather resistant strip adapted for use between a base and decorative layer attached to an automotive body for example is shown in U.S. Pat. No. 4,169,184 wherein a body of open celled, high density, flexible urethane foam that is impregnated with a vulcanized polychloroprene elastomer to form a deformable base material is described, the base being coated on opposite sides with a pressure sensitive adhesive. The tape or strip may be dispensed in a roll form and is made to have a significant inherent resilience and flexibility yet is described as including an ability to withstand elongation. The tape is prepared to be non-absorbent and solvent resistant for use in areas where gasoline, oils and greases might cause problems.

U.S. Pat. No. 4,199,645 also shows a laminated adhesive strip having an elastic carrier layer coated on opposed sides with adhesive layers having different characteristics for adhesion to different types of surfaces.

a basic form of a flexible and deformable strip coated on both sides with a pressure sensitive adhesive is illustrated in U.S. Pat. No. 2,292,024. This teaching provides an adhesive mounting strip for use between objects having irregular or undulating surfaces to provide a more uniform adhesive bonding action.

The use of release strips in combination with rolled up tapes having pressure sensitive adhesive on both sides thereof is known and typical tapes of this type are illustrated in U.S. Pat. Nos. 2,395,668, 2,565,509 and 4,169,184 mentioned above.

U.S. Pat. No. 2,882,183 describes a silicone tape backing having a single layer of a silicone adhesive on one side to form an electrical insulation that can be wrapped around an exposed electrical connection and then heated after it is in place to weld the layers of tape together to produce a sealed electrical covering.

U.S. Pat. No. 4,232,489 shows a flat strip of plastic foam forming a core for a tape with a pressure sensitive adhesive on one side for attaching the tape to a bow of a greenhouse enclosure for example, the tape having a silicone coated kraft paper adhered to its other side that forms a relatively friction free support surface for a sheet of plastic material laid on the exposed silicone impregnated paper material.

Thus the known flexible tapes show various types of adhesive strip structures adapted for insertion between elements to be associated together. However, none of these prior art teachings is directed to the problem of providing an effective substitute for a caulked seal between structural elements. It is the purpose of this invention to provide a sealant strip having various features of the known prior art combined together in a novel construction to satisfy the need for a flexible sealant strip adapted to mounting at the edges of abutting structural members to produce weather or moisture and air flow resistant seals along such joints to provide an effective seal.

None of the above described tapes is very well adapted to provide a substitute for a caulking such as is extruded conventionally into a joint to effect a waterproof seal for example, such caulking is usually applied after a structure has been erected. In this instance it is essential that the joint to be sealed to thoroughly cleaned before the caulking is forced into the joint and the sealant must be carefully applied through an extrusion nozzle moved along the joint. The proper quantity of sealant must be extruded to fill the joint and it must be applied in such a manner as to not interfere with the proper expansion and contraction of the seal in a manner to avoid breaking the seal. It is difficult to deliver the flowing sealant into the joint without some possibility of there being air holes, skips, and uneven application of the sealant in a manner to produce a uniform concave surface shape when it solidifies in place. In fact, the application of the usual caulking sealant in a joint after the structural parts have been assembled is so dependent on the skill of the operator that it should be considered more of an art than a science.

BRIEF DESCRIPTION OF THE INVENTION

It is the purpose of this invention to provide a sealant strip that may be laid up with the building elements forming a structure as they are being assembled to eliminate the need for caulking the joint between the elements after the assembly has been completed. In following this invention a flexible and resilient tape is trapped between these abutting elements to fill the joint and seal it.

It is the object of this invention to provide a resilient and elastic laminated sealant strip for use in forming such sealed joints between two structural elements which sealant strip may be installed in a manner to provide a barrier to moisture and air flow. The core of the strip is made of a foamed synthetic resin that has a relatively low density and low internal strength but which is resilient and elastic. Preferably the core has a rectangular crosssection and has two of its opposed sides coated with a layer of pressure sensitive adhesive. The remaining two sides are each coated with an integral cured thin layer of a flexible and resilient silicone rubber.

The sealant strip is adapted to be attached with the pressure sensitive adhesive to one element of a joint and the other abutting structural element is then moved into its assembled position in engagement with the other pressure sensitive adhesive coated on the other side of the strip. When the strip has thus been adhesively attached to both the elements at their junction, the silicone coatings which cover the other faces of the rectangular strip are facing the opposite exposed sides of the joint and the resilient and elastic core will hold the edges of each of these silicone surfaces pressed gently against the surfaces of the two structural elements to seal the joint. The silicone rubber coatings on the sides are impervious to moisture and air whereby an effective barrier seal is formed by compressing the sealant strip between the edges of the structural elements to be sealed.

In some instances it may be desirable to add a uniformly extruded sealing fillet at the edges of the silicone layer where the exposed layer is pressed against the structural element. Such a fillet along each edge of the exposed silicone layer can be used to more assuredly bond the sealant strip to both structural elements to ensure a perfect seal along the entire length of the joint.

DETAILED DESCRIPTION OF THE INVENTION

Figure 1:
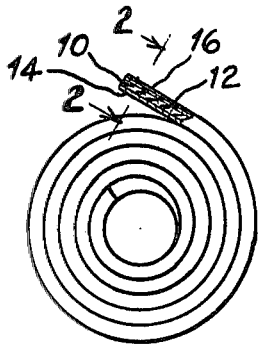
FIG. 1 is a side elevation showing the sealant strip as it is dispensed for use.
Figure 2:
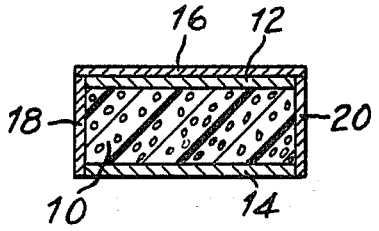
FIG. 2 is a crossectional view of one layer of the strip taken on line 2—2 of FIG. 1.

The flexible strip of this invention is preferably adapted to be packaged for distribution from the factory in a roll form as shown in FIG. 1. The strip includes a foam core 10 having a rectangular crossection and is made of a foamed synthetic resin selected from any of the conventionally known foamable open cell, flexible resilient synthetic resins such as a polyester-urethane foam. Other foamed core compositions may be used such as other resilient polymeric materials including polyvinyl chloride, polyisobutylene, polyethers, polyesters, silicone rubbers, fluorocarbon rubbers, butyl rubber, and polychloroprene.

The core is designed to be resilient and elastic to conform easily to the surface against which it is pressed as it is applied and for this purpose a foamed resin having a low internal strength is preferred. The core preferably is selected to have a density within the range of about one pound per cubic foot of the foamed core material.

Two opposed sides of the core are each coated respectively with thin layers or coatings 12 and 14 of a known pressure sensitive adhesive, preferably a tacky adhesive, such as an acrylic resin like that disclosed in U.S. Pat. No. 4,169,184, having the ability to tenaciously adhere to a wide variety of surfaces. Other suitable adhesives are those based on plastomerics like acrylic, polyvinylether, neoprene, styrene-butadiene, acrylonitrile, urethane, silicone, polyisobutylene and the like. These pressure sensitive adhesive layers cover essentially the entire surface of each of the opposed surfaces of the core 10 for maximum engagement of the strip with the structure with which it is to be associated with the entire length of one of the adhesive layers such as layer 12 of the roll is covered with a known type of cured silicone coated release tape 16 so that the roll may be easily unwound and the release tape is removed to expose the adhesive layer when the strip is to be applied to the elements forming the joint of a structure which is to be sealed. The adhesive may not be necessary in some applications but is certainly an aid to utilizing the sealant strip.

The remaining two sides of the core 10 are each entirely coated with an impervious layer of a high performance cured coating to form thin resilient sealing layers such as 18 and 20. These cured coatings produce water and air resistant seals over the exposed faces of the core of the sealant strip when it is in use as will be described more fully below. Preferably these coating are formed of a thin flexible, resilient silicone rubber material that can be easily deformed with the core material when the core is pressed and deformed between the two surfaces to be sealed to preclude the flow of moisture or air through the formed core that fills the space between the two elements of the structure. Other coating polymers include, among others, polyurethane, flexible epoxy and the like, as well as thermoplastic films like polyvinyl chloride.

Figure 3:
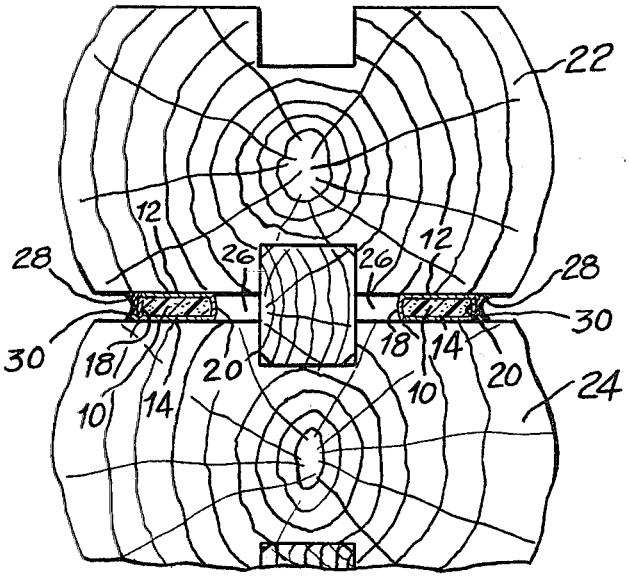
FIG. 3 is a crossectional view of a joint formed between structural elements, making use of this sealant strip.

The sealant strip is suggested for use in any joint being constructed by placing two mating parts together where a perceptible gap inherently is produced by the mating of the structural parts. The sealant strip is selected to have a width to fill the gap between the parts to be sealed and preferably should be compressed to a thickness of about 75% of its original thickness. Referring to FIG. 3 the strip is shown positioned between two logs 22 and 24 forming the wall of a builidng with the strip compressed in the gap 26 which has been illustrated in the drawings in an exaggerated degree. The sealant strip is positioned along the length of the joint and is compressed somewhat all along the length of the joint on an average of as much as 25% of its thickness whereby the core 10 resiliently presses the edges of the exposed sealing surfaces 18 and 20 tightly against the surfaces of the logs between which the strip is positioned.

Preferably the sealant strip installed in the gap of a joint between two structural elements can be more assuredly sealed by applying two small uniformly extruded fillet beads 28 and 30 length-wise along the edges of the exposed sealing layer 18 as shown in FIG. 3. The fillet material is selected to be one that bonds to the surface of the structural elements 22 and 24 and is also compatible with and bonds to the cured sealing layer 18. Usually a silicone fillet material will be found most useful for bonding to most surfaces and the cured silicone sealing layer as is used in the preferred construction of this sealant strip. However, other caulking materials are operable as well, such as butylrubber, polysulfide or phenolic based materials.

As will be understood from the above, this strip suggests itself for use in effectively weather sealing a joint between logs in a structure where exact tolerances cannot always be easily maintained. Also for example in the installation of curtain walls in a building, this sealant strip will be found most useful.

It is apparent that the sealant strip described above may be utilized to completely seal many joints that occur in normal building structures that have heretofore required the application of caulking to seal the joint after the structure has been completed. The disadvantages inherent in the application of an extruded caulking into a joint are completely eliminated when the herein disclosed sealant strip is used in such joints. The cured sealing layers 18 and 20 preclude the flow of air or moisture into the joint and thus form a most effective seal especially as in the preferred form when fillets which may be easily extruded, are used. It is to be noted that when such fillets are laid over the joint between the structural elements and coatings 18 and 20, the fillets need be placed merely in contact with both surfaces to which the fillets are bonded and need not be made to fill the space in a joint having a variable thickness as when extruding caulking into a joint.

The sealing layers 18 and 20 with or without the fillets at their edges always provide a uniformly disposed sealing bridge between the structural elements and may be colored to provide an artistic seam if desired. This more uniform appearance at the seam is realized by the simple placement of the sealant strip in the joint as the structure is assembled, no special skill being required to assure a perfect alignment and shape of the joint as compared with the craftsmanship required for properly extruding a caulked seal in a joint.

While the invention has been described in terms of a sealant strip having a rectangular cross section, it is to be understood that it may take on a different cross section depending on its specific use, e.g. a U-shaped sealant strip could be used to bed a curtain wall; or the cross-section could be I shaped, or the like.

The above describes the preferred form of my invention but it is suggested that modifications thereof may occur to those skilled in the art that will fall within the scope of the claims which follow.

What is claimed is:

1. A strip adapted to be used for sealing a joint between two abutting structural elements comprising a core of foamed synthetic resin that is resilient and elastic, and which includes on two sides thereof, a high performance cured flexible coating that is impervious to water and air, and at least one of remaining two sides being coated with a pressure sensitive adhesive layer.

2. A strip according to claim 1 wherein said foamed synthetic resin is one selected from the group consisting of polyurethane, polyvinyl chloride, polystyrene, polyisobutylene, polyethers, polyesters, silicone rubber, fluorocarbon rubbers, butyl rubber, and polychloroprene.

3. A strip according to claim 2 wherein said high performance cured flexible coating is one selected from the group consisting of silicone rubber and polyurethane.

4. A strip according to claim 1 wherein said core has a generally rectangular crossection and a layer of a pressure sensitive adhesive carried on at least one side of the core; and wherein two of the remaining sides have a thin, resilient layer in the form of a high performance cured coating thereon that is impervious to water and air.

5. A strip as in claim 1 wherein said layer of a high performance cured coating is a silicon rubber resin.

6. A strip as in claim 1 rolled into a coil for storage until used wherein a release tape is carried on one of said pressure sensitive layers and said strip is wound into a roll with said release liner separating the coils of the roll to permit easy unrolling of the rolled strip for applying the strip to one of said structural elements, and wherein said liner may be left on said one surface of the unrolled strip until the other structural element is brought into engagement with said strip so that a sealed joint can be completed.

7. A strip as in claim 1 wherein said core has a low internal strength.

8. A strip as in any of claims 1, 2, 3 and 4 wherein said core has a low density in the range of one pound per cubic foot.

9. A strip as in claim 1 wherein said core has a thickness of up to three fourths of an inch between said sides that are covered with the pressure sensitive adhesive.

10. A sealant strip adapted to be used for sealing a joint between two abutting structural elements comprising a core of foamed resilient polyurethane having a rectangular cross section, two opposite sides of said sealant strip being coated with a pressure sensitive adhesive, and the remaining two sides of the sealant strip having a thin layer of a cured silicone rubber thereon.

11. A sealed joint between two opposed edges of adjacent structural elements comprising a generally rectangularly shaped sealant strip compressed between the opposed edges of said elements in a manner to leave two sides of the strip exposed, pressure sensitive adhesive layers on opposite sides lengthwise of said strip which sides are engaged by said edges for bonding the strip to each of said opposed edges leaving said two sides exposed, each of said exposed sides having a thin, resilient layer in the form of a high performance cured coating thereon that is impervious to water and air, and said impervious layer being in contact with the opposed edges of said elements.

12. A sealed joint as in claim 11 wherein said thin resilient layers are cured coatings of a silicone rubber resin.

13. A sealed joint as in claim 11 wherein fillets are disposed lengthwise along at least one of said thin resilient layers thereby bonding said opposed edges of said elements to said layers.

14. A sealed joint as in claim 13 wherein said fillets are a resin compatible with said elements and a silicon rubber layer.

* * * * *